US007434660B2

(12) United States Patent
Yamagiwa et al.

(10) Patent No.: US 7,434,660 B2
(45) Date of Patent: Oct. 14, 2008

(54) PERFORATED SOUNDPROOF STRUCTURE AND METHOD OF MANUFACTURING THE SAME

(75) Inventors: Ichiro Yamagiwa, Kobe (JP); Toshimitsu Tanaka, Kobe (JP); Hiroki Ueda, Kobe (JP); Hideo Utsuno, Kobe (JP); Toru Sakatani, Kobe (JP); Akio Sugimoto, Kobe (JP)

(73) Assignee: Kabushiki Kaisha Kobe Seiko Sho, Hyogo (JP)

( * ) Notice: Subject to any disclaimer, the term of this patent is extended or adjusted under 35 U.S.C. 154(b) by 206 days.

(21) Appl. No.: 10/481,003

(22) PCT Filed: Jun. 17, 2002

(86) PCT No.: PCT/JP02/06004

§ 371 (c)(1),
(2), (4) Date: Dec. 17, 2003

(87) PCT Pub. No.: WO03/001501

PCT Pub. Date: Jan. 3, 2003

(65) Prior Publication Data

US 2004/0191474 A1 Sep. 30, 2004

(30) Foreign Application Priority Data

Jun. 21, 2001 (JP) ..... 2001-188444
Jun. 21, 2001 (JP) ..... 2001-188455

(51) Int. Cl.
*E04B 1/82* (2006.01)
*E04B 1/84* (2006.01)
*E04B 2/02* (2006.01)
*E04B 1/74* (2006.01)

(52) U.S. Cl. ..... 181/293; 181/290

(58) Field of Classification Search ..... 181/293, 181/290, 286, 204
See application file for complete search history.

(56) References Cited

U.S. PATENT DOCUMENTS 2,159,488 A * 5/1939 Parkinson ..... 52/145

(Continued)

FOREIGN PATENT DOCUMENTS

EP 0 677 429 A1 4/1995

(Continued)

OTHER PUBLICATIONS

International Search Report of PCT/JP02/06004 mailed on Oct. 8, 2002.

(Continued)

*Primary Examiner*—Edgardo San Martin
(74) *Attorney, Agent, or Firm*—Reed Smith LLP; Stanley P. Fisher, Esq.; Juan Carlos A. Marquez, Esq.

(57) ABSTRACT

A perforated soundproof structure is formed by oppositely arranging an external plate 1 and an internal plate 2 having a number of through-holes 2*a*. The board thickness, hole diameter and open area ratio of the internal plate 2 are set to satisfy design conditions to give rise to a viscous effect in the air passing through the through-holes 2*a*, and the design conditions are set so that the frequency bandwidth to attain an absorption coefficient of 0.3 or more is 10% or more of the resonance frequency.

9 Claims, 17 Drawing Sheets

U.S. PATENT DOCUMENTS

| | | | | | |
|---|---|---|---|---|---|
| 2,966,954 | A | * | 1/1961 | Sabine | 181/289 |
| 4,411,121 | A | * | 10/1983 | Blacklin et al. | 52/789.1 |
| 4,529,637 | A | * | 7/1985 | Hankel | 428/49 |
| 4,669,573 | A | * | 6/1987 | Goodman | 181/286 |
| 4,755,416 | A | * | 7/1988 | Schneider et al. | 428/167 |
| 4,850,093 | A | | 7/1989 | Parente | |
| 5,124,191 | A | | 6/1992 | Seksaria | |
| 5,244,745 | A | | 9/1993 | Seksaria et al. | |
| 5,532,440 | A | * | 7/1996 | Fujiwara | 181/289 |
| 5,681,072 | A | * | 10/1997 | Stricker | 296/39.3 |
| 5,744,763 | A | * | 4/1998 | Iwasa et al. | 181/286 |
| 5,892,187 | A | * | 4/1999 | Patrick | 181/286 |
| 5,942,736 | A | * | 8/1999 | Cortonesi | 181/289 |
| 5,997,985 | A | * | 12/1999 | Clarke et al. | 428/116 |
| 6,021,612 | A | * | 2/2000 | Dunn et al. | 52/144 |
| 6,345,688 | B1 | * | 2/2002 | Veen et al. | 181/290 |
| 6,598,701 | B1 | * | 7/2003 | Wood et al. | 181/290 |
| 6,820,720 | B1 | | 11/2004 | Nicolai et al. | |
| 2005/0133302 | A1 | | 6/2005 | Pfaffelhuber et al. | |

FOREIGN PATENT DOCUMENTS

| | | | | |
|---|---|---|---|---|
| EP | 1 161 360 | B1 | | 4/2000 |
| EP | 1 202 874 | B1 | | 8/2000 |
| JP | 52-132402 | | | 4/1976 |
| JP | 56-500500 | | | 5/1980 |
| JP | 62-57523 | | | 9/1985 |
| JP | 6-298014 | | | 4/1993 |
| JP | 53-130813 | | | 10/1995 |
| JP | 9-288488 | | | 4/1996 |
| JP | 2000-34938 | | | 7/1998 |
| JP | 2000-168622 | | | 12/1998 |
| JP | 2001122050 | A | * | 5/2001 |
| JP | 2001122052 | A | * | 5/2001 |

OTHER PUBLICATIONS

Dah-You Maa, "Microperforated-Panel Wideband Absorbers", Noise Control Engineering Journal, vol. 29, No. 3, Nov-Dec 1987, pp. 77-84.

EPO Supplementary European Search Report dated May 14, 2008.

EPO Supplementary European Search Report dated May 14, 2008.

* cited by examiner

BOARD THICKNESS OF INTERNAL PLATE 0.8mm

BOARD THICKNESS OF INTERNAL PLATE 0.8mm

PERFORATED SOUNDPROOF STRUCTURE AND METHOD OF MANUFACTURING THE SAME

TECHNICAL FIELD

The present invention relates to a perforated soundproof structure for reducing sounds from a noise generating source, and a method of manufacturing the same.

BACKGROUND ART

In recent years, a perforated soundproof structure for insulating sounds by the Helmholz resonance principle by oppositely arranging an internal plate having a number of through-holes formed on the whole surface and an external plate through an air layer have attracted attention. For example, in Japanese Patent Application Laid-open (Kokai) No. 6-298014, there is disclosed, focusing on that the general equation of the Helmholz resonance principle is "$f=(c/2\pi)\times\sqrt{\{\beta/(t+1.6b)d\}}$", a perforated sound insulating structure constituted to efficiently reduce noise of a specified resonance frequency f based on this general equation. In the above general equation, the resonance frequency f is represented by use of sound velocity c, open area ratio β, board thickness of internal plate t, hole diameter b and layer thickness of back air layer d as parameters.

In such a perforated soundproof structure constituted based on the general equation of the Helmholz resonance principle as in the past, the absorption coefficient to noises of frequencies other than the resonance frequency f can be extremely lowered depending on the way to combine the parameters. Therefore, it sometimes cannot exhibit sufficient sound absorbing performance to noises containing a plurality of frequencies as peak components.

Namely, the present inventors examined the relation between absorption coefficient α and frequency with parameters determined based on the above general equation to attain, for example, a resonance frequency f of 750 Hz. Consequently, as shown in FIG. 20, it was confirmed that some structures show sound absorbing characteristics that the peak value of the absorption coefficient α appears at 750 Hz that is the resonance frequency f, and the absorption coefficient α sharply drops from this peak value. In this case, when "0.3" is set as the threshold of the absorption coefficient α for exhibiting sufficient sound absorbing performance, the frequency bandwidth of sound absorbing characteristics in this threshold is about 41 Hz, which indicates that sufficient sound absorbing performance can be exhibited only at a bandwidth of 6% of the resonance frequency f of 750 Hz.

Accordingly, the conventional structures, as described above, have the problem that noises of a wide frequency bandwidth cannot be sufficiently insulated because the sound absorbing performance to noises other than the resonance frequency f is often extremely inferior. They also have the problem that experimental manufacture must be repeated until parameters for excellent sound insulating performance can be obtained in the determination of parameters based on the above-mentioned general equation.

On the other hand, a drive mechanism such as engine is not only a generating source of noise but also a generating source of mechanical vibration. At this time, even if designed according to the above general equation of the Helmholz resonance principle, the noise-proof cover is excited by the vibration of the drive mechanism, and the noise-proof cover itself, as a result, vibrates to generate noise. Accordingly, its soundproof performance is insufficient as a noise-proof cover for automobile that is mechanically excited, too.

The present invention has a principle object to provide a perforated soundproof structure capable of surely exhibiting sufficient sound absorbing performance and a method of manufacturing the same.

DISCLOSURE OF THE INVENTION

The present invention includes a perforated soundproof structure formed by oppositely arranging an external plate and an internal plate having a number of through-holes, characterized by that the thickness, hole diameter and open area ratio of the internal plate are set so as to satisfy design conditions to give rise to a viscosity effect in the air passing through the through-holes, and the design conditions are set so that the frequency bandwidth to attain an absorption coefficient of 0.3 or more is 10% or more of the resonance frequency.

Since this perforated soundproof structure is formed by use of the internal plate having the thickness, hole diameter and open area ratio satisfying the design conditions to give rise to the viscous effect in the air, the conversion of air vibration to thermal energy by the viscous effect is promoted. Consequently, sufficient sound absorbing performance can be surely exhibited at a wide frequency bandwidth. This structure thus has excellent sound absorbing performance to, in addition to the noise of the resonance frequency, noises other than this frequency.

In this perforated soundproof structure of the present invention, the open area ratio of the through-holes is preferably 3% or less.

According to this structure, the forming time of the internal plate can be shortened by reducing the number of through-holes while ensuring sufficient sound absorbing performance. The manufacturing cost can be thus reduced.

In this perforated soundproof structure of the present invention, preferably, the hole diameter of the through-holes is 3 mm or less, and the sound source to be insulated is 70 dB or more.

According to this structure, the conversion of air vibration to thermal energy by the effect corresponding to pressure loss is promoted when the hole diameter of the through-holes is larger than 1 mm, and sufficient sound absorbing performance can be consequently exhibited at a wide frequency bandwidth, in addition to the sound absorbing performance by the viscous effect. The damping effect (proportional to flow velocity squared) by pressure loss is remarkable in the sound absorbing effect in an area having a high flow velocity, compared with the viscous damping effect (proportional to flow velocity), and excellent sound absorbing performance is exhibited in an area having a high sound pressure level, particularly, 70 dB or more to be insulated.

In this perforated soundproof structure of the present invention, the hole diameter of the through-holes is preferably 1 mm or less.

The viscous effect can be surely generated in the air thereby.

The perforated soundproof structure of the present invention is characterized by that the internal plate consists of two or more internal plates provided through an air layer.

According to this structure, resonance frequencies according to the number of internal plates can be made appear to improve sound absorbing performance not only in the vicinity of a specified frequency but also in a plurality of frequency bands. Therefore, sufficient sound absorbing performance can be surely exhibited in a wide frequency band.

The present invention includes a perforated soundproof structure formed by oppositely arranging an external plate and an internal plate having a number of through-holes, characterized by that the board thickness, hole diameter and open area ratio of the internal plate are set so as to satisfy design conditions to give rise to a viscous effect in the air passing through the through-holes.

Since this perforated soundproof structure is formed by use of the internal plate having the thickness, hole diameter and open area ratio satisfying the design conditions to give rise to the viscous effect in the air, the conversion of air vibration to thermal energy by the viscous effect is promoted. Consequently, sufficient sound absorbing performance can be surely exhibited at a wide frequency bandwidth. This structure thus has excellent sound absorbing performance to, in addition to the noise of the resonance frequency, noises other than this frequency.

The present invention includes a perforated soundproof structure formed by oppositely arranging an external plate and an internal plate having a number of through-holes, characterized by that the open area ratio of the through-holes is 3% or less.

According to this structure, the forming time of the internal plate can be shortened by reducing the number of through-holes while retaining sufficient sound absorbing performance. The manufacturing cost can be thus reduced.

The present invention includes a perforated soundproof structure formed by oppositely arranging an external plate and an internal plate having a number of through-holes, characterized by that the hole diameter of the through-holes is 3 mm or less, and the sound source to be insulated is 70 dB or more.

According to this structure, the conversion of air vibration to thermal energy by the effect corresponding to pressure loss is promoted when the hole diameter of the through-holes is larger than 1 mm, and sufficient sound absorbing performance can be consequently exhibited at a wide frequency bandwidth, in addition to the sound absorbing performance by the viscous effect. The damping effect (proportional to flow velocity squared) by pressure loss is remarkable in the sound absorbing effect in an area having a high flow velocity, compared with the viscous damping effect (proportional to flow velocity), and excellent sound absorbing performance is exhibited in an area having a high sound pressure level, particularly, 70 dB or more to be insulated.

The present invention includes a perforated soundproof structure formed by oppositely arranging an external plate and an internal plate having a number of through-holes, characterized by that the hole diameter of the through-holes is 1 mm or less.

According to this structure, by generating the viscous effect in the air, the conversion of air vibration to thermal energy by the viscous effect is promoted, and sufficient sound absorbing performance can be consequently surely exhibited at a wide frequency bandwidth. This structure thus has excellent sound absorbing performance to, in addition to the noise of the resonance frequency, noises other than this frequency.

The present invention includes a perforated soundproof structure formed by oppositely arranging an external plate and an internal plate having a number of through-holes, characterized by that the internal plate consists of two or more internal plates provided through air layer.

According to this structure, resonance frequencies according to the number of the internal plates can be made appear to improve sound absorbing performance not only in the vicinity of a specified frequency but also in a plurality of frequency bands. Therefore, sufficient sound absorbing performance can be surely exhibited at a wide frequency bandwidth.

The present invention includes a perforated soundproof structure formed by oppositely arranging an external plate and an internal plate having a number of through-holes, characterized by that protruding parts are formed on the internal plate so that their apexes are located on the external plate side, and the apexes of the protruding parts are bonded to the external plate through a damping member for damping vibration.

According to this structure, noises of a wide frequency bandwidth can be satisfactorily absorbed. On the other hand, even if the external plate is vibrated by mechanical excitation, the generation of noise by the vibration of the external plate itself can be suppressed since the damping member absorbs the energy resulted from this vibration to damp the vibration. Consequently, this structure is most suitable as a noise-proof cover for automobile or rolling stock that requires the sound insulating performance to noise and the sound insulating performance to mechanical excitation.

In this perforated soundproof structure of the prevent invention, the damping member is preferably a sound absorbing member having the function of absorbing noise.

According to this structure, since the damping member absorbs noises, in addition to the suppression of vibration of the external plate, the sound insulating performance can be further improved.

In this perforated soundproof structure of the present invention, the sound absorbing member is preferably a porous body formed by compressing a fibrous or rectangular metal or a porous body made of a nonwoven fabric.

According to this structure, since this sound absorbing member can be formed by use of a porous body consisting of a general material, the rise of manufacturing cost can be suppressed.

This perforated soundproof structure of the present invention preferably further comprises a sound absorbing member for absorbing noise provided around the damping member.

Since this sound absorbing member absorbs noises of a wide frequency band, the sound insulating performance can be further improved.

In this perforated soundproof structure of the present invention, the sound absorbing member is preferably a porous body obtained by compressing a fibrous or rectangular metal or a porous body made of a nonwoven fabric.

According to this structure, since this sound absorbing member can be formed by use of a porous body consisting of a general material, the rise of manufacturing cost can be suppressed.

In this perforated soundproof structure of the present invention, the sound absorbing member is preferably provided entirely over the sound source side of the internal plate.

According to this structure, since the sound absorbing member absorbs noises of a wide frequency bandwidth, the sound insulating performance can be further improved.

In this perforated soundproof structure of the present invention, the sound absorbing member is preferably a porous body obtained by compressing a fibrous or rectangular metal or a porous body made of a nonwoven fabric.

According to this structure, since this sound absorbing member can be formed by use of a porous body consisting of a general material, the rise of manufacturing cost can be suppressed.

In this perforated soundproof structure of the present invention, the sound absorbing member consists of one or more perforated plates having a number of through holes arranged through air layer.

When one or more perforated plates are superposed through air layer in the internal plate, resonance frequencies corresponding to the number of the perforated plates can be made appear, in addition to the resonance frequency by the internal plate, to satisfactorily absorb noises of frequency bandwidths around these resonance frequencies, and noises of a wide frequency band can be absorbed. Therefore, the sound insulating performance can be further improved.

The present invention includes a perforated soundproof structure formed by oppositely arranging an external plate and an internal plate having a number of through-holes, characterized by that the thickness, hole diameter and open area ratio of the internal plate are set to satisfy design conditions to give rise to a viscous effect in the air passing through the through-holes, the design conditions are set so that the frequency bandwidth to attain an absorption coefficient of 0.3 or more is 10% or more of the resonance frequency, the internal plate has protruding parts formed so that their apexes are located on the external plate side, and the apexes of the protruding parts are bonded to the external plate through a damping member for damping vibration.

According to this structure, since this perforated soundproof structure is formed by use of the internal plate having the thickness, hole diameter and open area ratio satisfying the design conditions to give rise to a viscous effect in the air, the conversion of air vibration to thermal energy by the viscous effect is promoted, and sufficient sound absorbing performance can be surely exhibited at a wide frequency bandwidth. This structure thus has excellent sound absorbing performance to, in addition to the noise of the resonance frequency, noises other than this frequency.

On the other hand, even if the external plate is vibrated by mechanical excitation, the generation of noise by the vibration of the external plate itself can be suppressed since the damping member absorbs the distortion energy accompanied by this vibration to damp the vibration. Consequently, this structure is most suitable as a noise-proof cover for automobile or rolling stock that requires the sound insulating performance to noise and the sound insulating performance to mechanical excitation.

The present invention involves a method of manufacturing a perforated soundproof structure formed by oppositely arranging an external plate and an internal plate having a number of through-holes, characterized by that the thickness, hole diameter and open area ratio of the internal plate are determined to satisfy at least design conditions to give rise to a viscous effect in the air passing through the through-holes, and the internal plate is then formed based thereon and assembled to the external plate.

Since the thickness, hole diameter and open area ratio of the internal plate satisfying the design conditions to give rise to a viscous effect in the air are preliminarily determined in design stage, a perforated soundproof structure excellent in sound absorbing performance can be completed at a lower cost in a shorter time than in the determination of the design conditions of suitable thickness, hole diameter and the like by trial and error.

The present invention involves a method of manufacturing a perforated soundproof structure formed by oppositely arranging an external plate and an internal plate having a number of through-holes, characterized by that the thickness, hole diameter and open area ratio of the internal plate are determined with a sound source to be insulated of 70 dB or more so as to satisfy design conditions to give rise to a viscous effect in the air passing through the through-hole, and the internal plate is formed with at least the hole diameter of the through-holes being 3 mm or less, and assembled to the external plate.

According to this structure, since the thickness, hole diameter and open area ratio of the internal plate satisfying the design conditions to give rise to the viscous effect in the air are preliminarily determined with the sound source to be insulated being 70 dB or more, and at least the hole diameter of the through-holes is then set to 3 mm or less, a perforated soundproof structure excellent in sound absorbing performance can be completed at a lower cost in a shorter time than in the determination of the design conditions of suitable thickness, hole diameter and the like by trial and error. Since the sound source to be isolated is 70 dB or more, a perforated soundproof structure according to noise source can be provided.

BEST MODE FOR CARRYING OUT THE INVENTION

The perforated soundproof structure according to the present invention and the method of manufacturing the same will be described in detail with reference to the preferred embodiments thereof. However, the perforated soundproof structure and method of manufacturing the same according to the present invention are never limited by the following preferred embodiments.

The perforated soundproof structure according to the preferred embodiments can be applied similarly to a site where a conventional sound absorbing member is used. It is used, for example, to various kinds of noise sources such as motor or gear as a component panel for a sound insulating fence for realizing internal sound absorption and external sound insulation. Further, it is also applicable as a sound absorbing plate for hall or living room.

The first embodiment of the perforated soundproof structure according to the present invention is described in reference to FIGS. 1-10.

Figure 1:
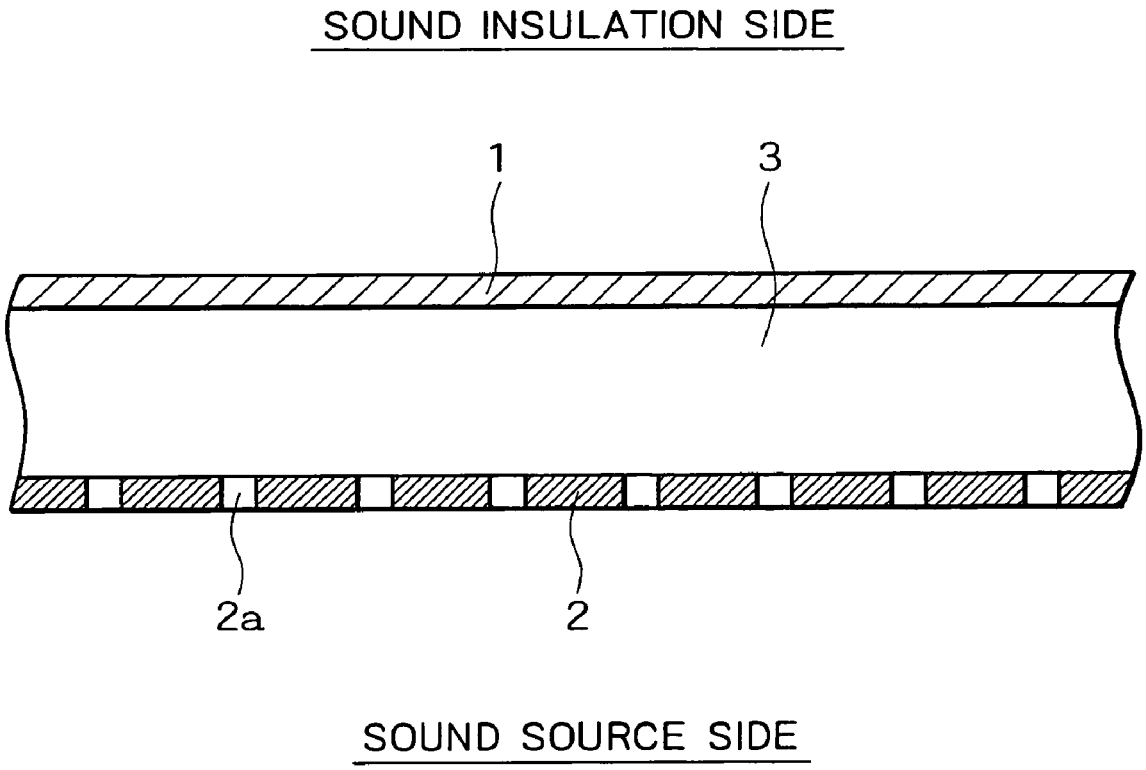
FIG. 1 is a sectional view showing a perforated soundproof structure according to a first embodiment of the present invention.

The perforated soundproof structure shown in FIG. 1 comprises an external plate 1 facing the outside where noise is at stake, and an internal plate 2 facing a sound source side. The external plate 1 and internal plate 2 are formed of metals such as iron or aluminum or a synthetic resin. The external plate 1 and internal plate 2 are desirably formed of the same material to dispense with the separating work in recycle.

The external plate 1 and internal plate 2 are oppositely arranged through an air layer 3. The internal plate 2 has a number of circular through-holes 2*a*. Parameters including the layer thickness d of the air layer 3, the open area ratio β and board thickness t of the internal plate 2, and the hole diameter b of the through-holes 2*a* are set so as to give rise to a viscous effect in the air passing through the through-holes 2*a* of the internal plate 2. Accordingly, the structure has sound absorbing characteristics such that the frequency bandwidth to attain an absorption coefficient of 0.3 or more is 10% or more of the resonance frequency f.

Namely, the parameters of the perforated soundproof structure are set on the basis of design conditions of open area ratio β of 3% or less, board thickness t of 0.3 mm or more, and hole diameter b of 1 mm or less in a layer thickness d of 10-50 mm so as to have the above sound absorbing characteristics. The frequency bandwidth to attain an absorption coefficient of 0.3 or more tends to extend as a smaller open rear ratio β, a larger board thickness t, and a smaller hole diameter b are exhibited.

Figure 2:
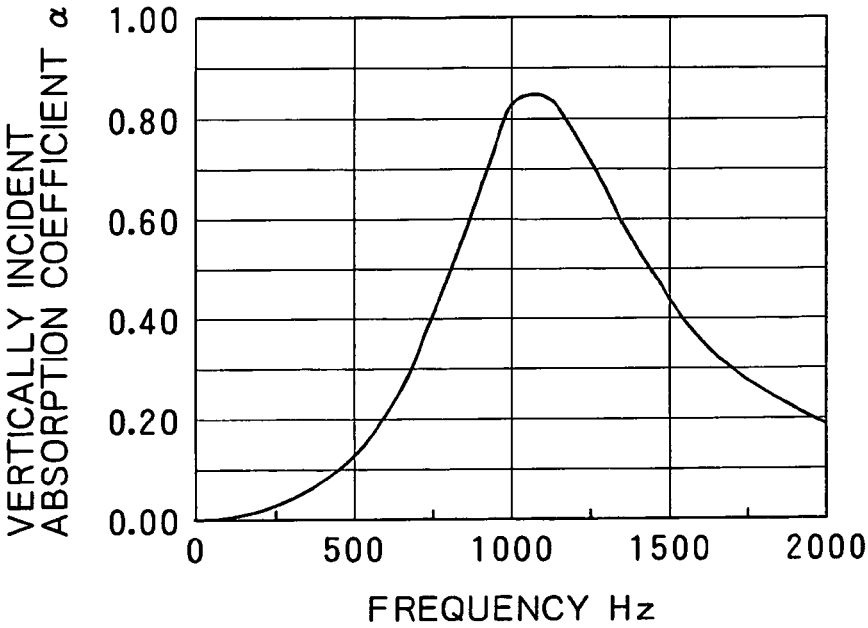
FIG. 2 is a graph showing sound absorbing characteristics in the first embodiment.

Concretely, when the parameters are set to a layer thickness d of 25 mm, an open area ratio β of 1%, a board thickness t of 0.3 mm, and a hole diameter b of 0.5 mm, the perforated soundproof body has sound absorbing characteristics that the frequency bandwidth of 1067 Hz is 97% of the resonance frequency f of 1100 Hz, as shown in FIG. 2.

Figure 3:
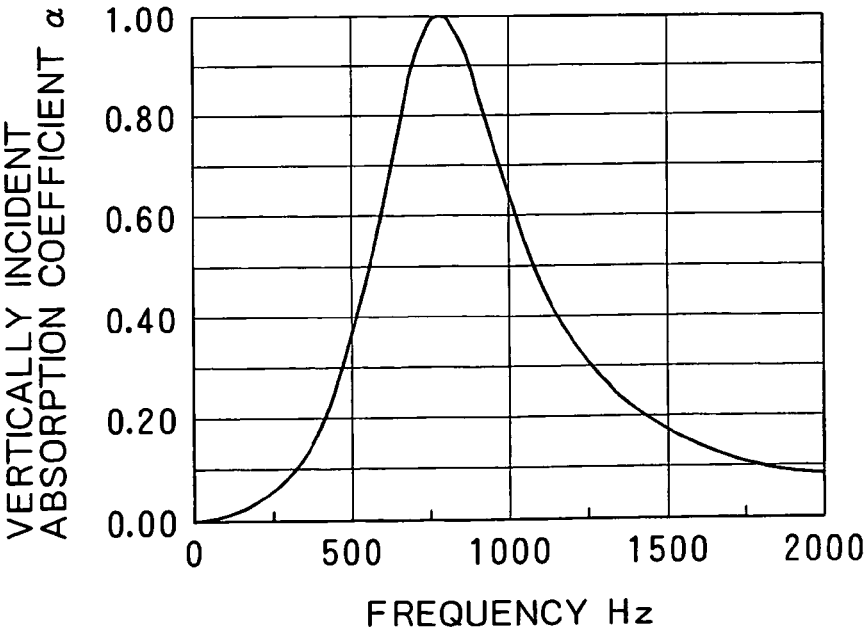
FIG. 3 is a graph showing sound absorbing characteristics in the first embodiment.

When the parameters are set to a layer thickness d of 25 mm, an open area ratio β of 1%, a board thickness of 1.0 mm, and a hole diameter b of 0.5 mm, the perforated soundproof body has sound absorbing characteristics that the frequency bandwidth of 806 Hz is 107% of the resonance frequency f of 750 Hz, as shown in FIG. 3.

The reason for the extension of the frequency bandwidth having a large absorption coefficient by generation of the viscous effect in the air is that damping property is generated in the vibration of the air by the viscous effect of the air.

The method of manufacturing the above-mentioned perforated soundproof structure will be described.

It is measured or estimated that what kind of peak components the frequency characteristics of the noise to be insulated has. Based on the design conditions of a layer thickness d of 10-50 mm, an open area ratio β, of 3% or less, a board thickness t of 0.3 mm or more, and a hole diameter b of 1 mm or less, the parameters are determined considering the air viscosity so as to have sound absorbing characteristics that the absorption coefficient of the frequency bandwidth including the peak components is 0.3 or less.

A perforated soundproof structure is experimentally manufactured with the parameters determined above, and the internal plate 2 is arranged to be located on the noise-generating sound source side. A microphone is arranged on the noise-generating sound source side to measure the sound pressure level, whereby the sound absorbing performance is confirmed.

Since the parameters were determined based on only the general equation of the Helmholz resonance principle that paid attention only to resonance frequency in a conventional manufacturing method, parameters that can exhibit sufficient sound absorbing performance only in a narrow frequency bandwidth were sometimes selected. Accordingly, the probability of determining the parameters improper is high, and the experimental manufacture must be performed a number of times.

According to the method of this embodiment, since parameters capable of exhibiting sufficient sound absorbing performance in a wide frequency bandwidth are preliminarily determined in design stage, the probability of impropriety determination in a sound absorbing performance test after experimental manufacture is extremely minimized. Accordingly, the frequency of experimental manufactures can be reduced, and a desired perforated soundproof structure can be obtained in a short time at a low cost.

Figure 4:
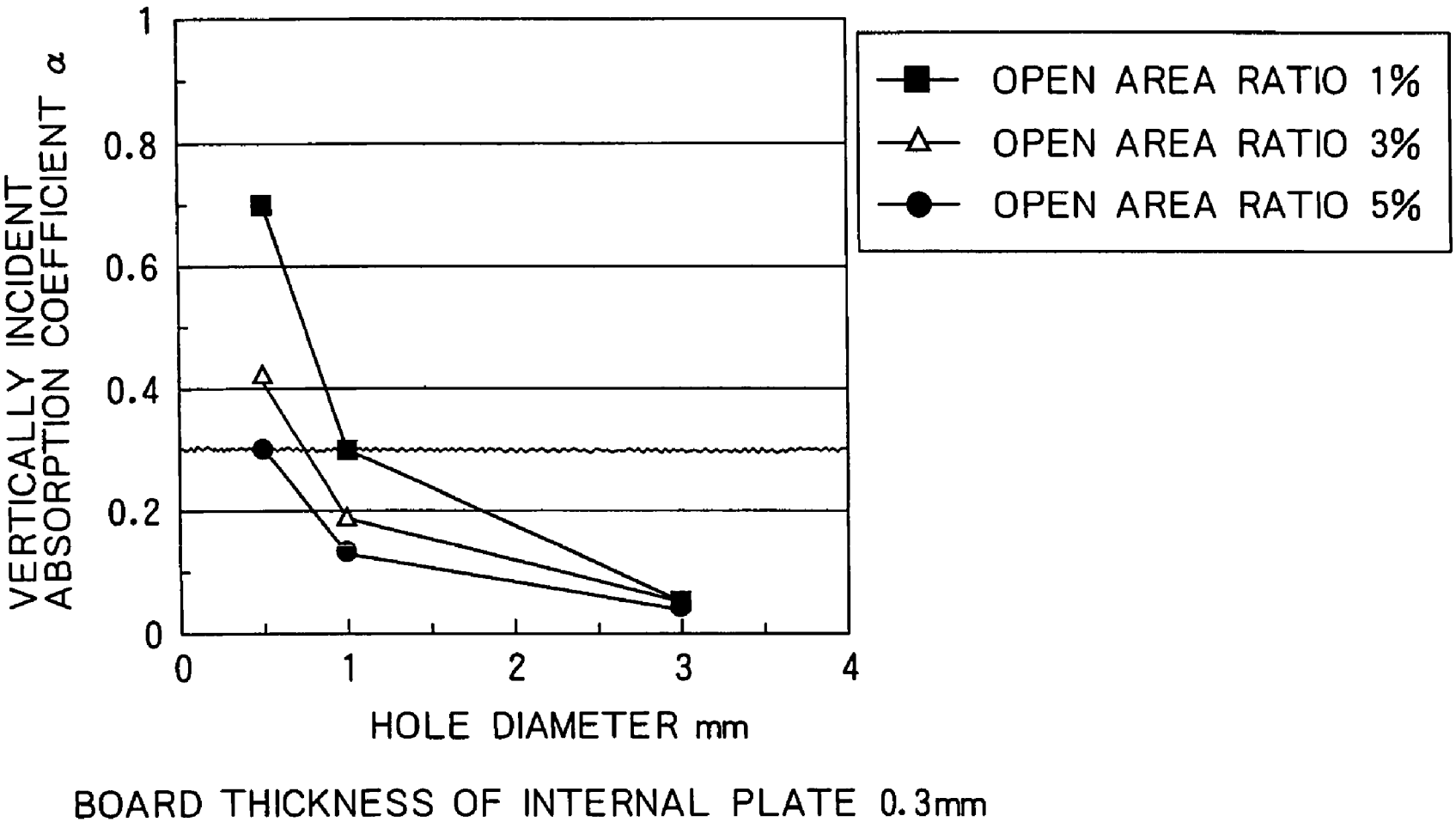
FIG. 4 is a graph showing the relation among absorption coefficient, hole diameter and open area ratio in a board thickness of 0.3 mm.
Figure 5:
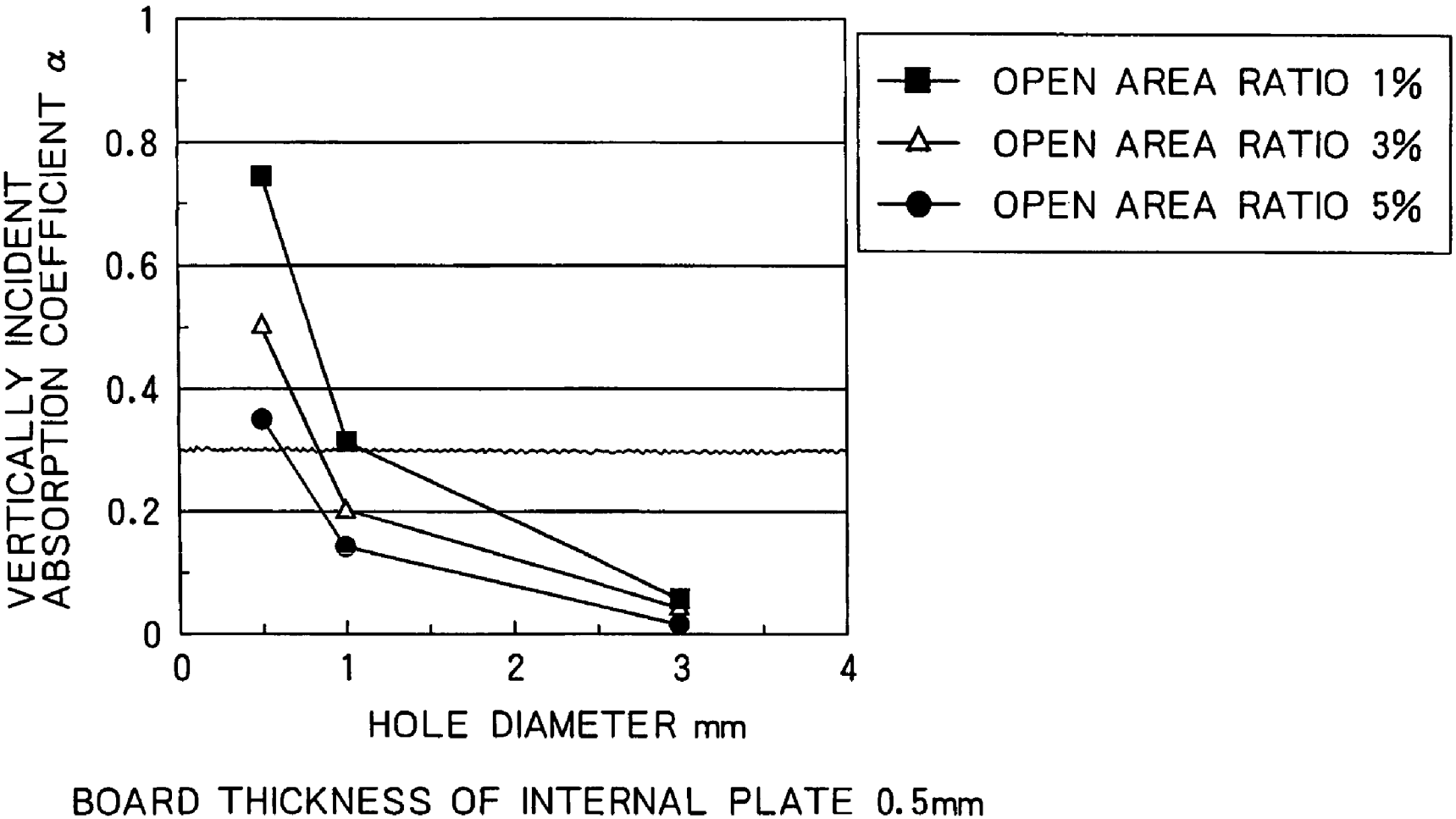
FIG. 5 is a graph showing the relation among absorption coefficient, hole diameter and open area ratio in a board thickness of 0.5 mm.
Figure 6:
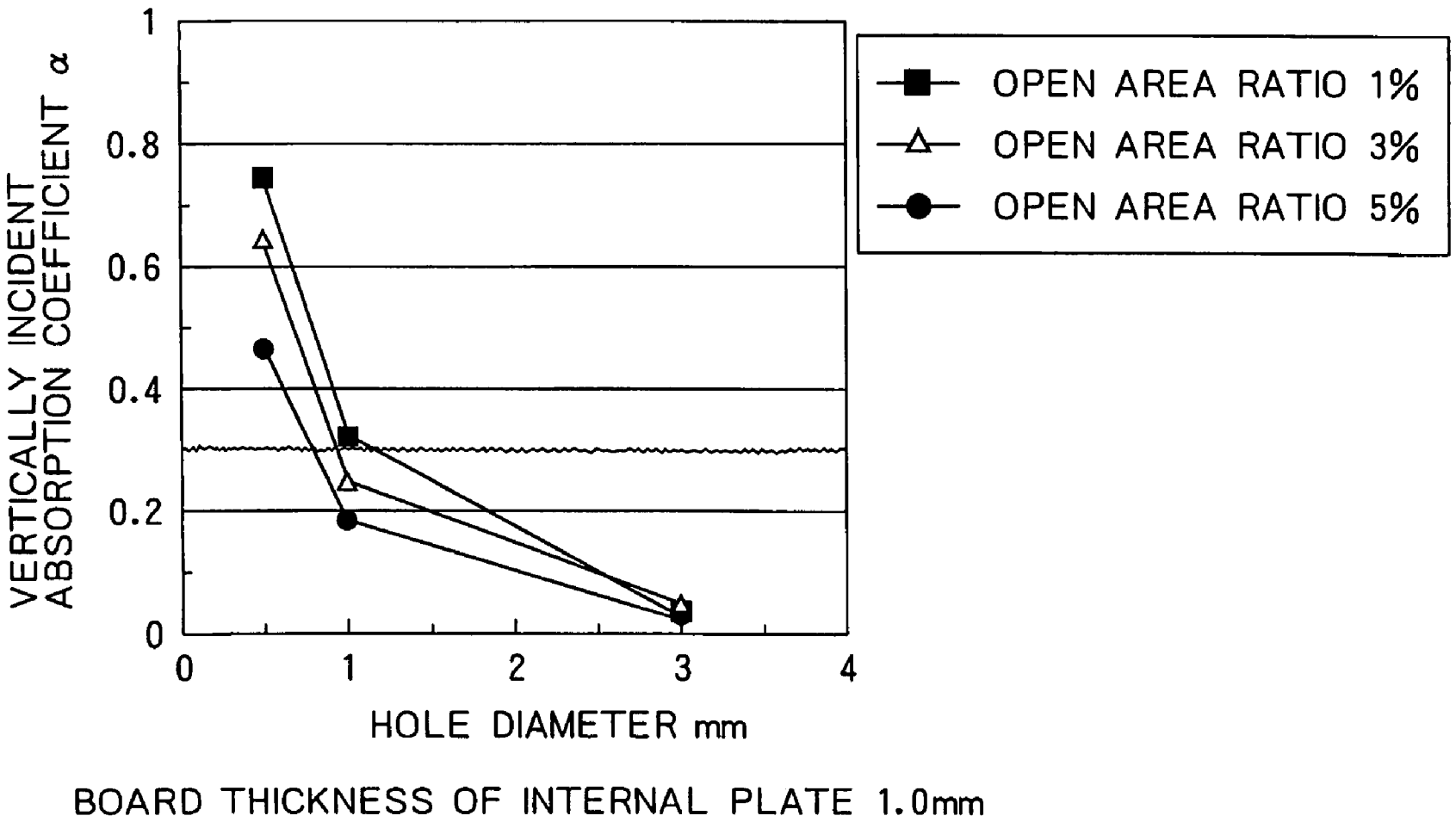
FIG. 6 is a graph showing the relation among absorption coefficient, hole diameter and open area ratio in a board thickness of 1.0 mm.

The derivation method of the design conditions is then described in reference to FIGS. 4-6.

In the perforated soundproof structure shown in FIG. 1, absorption coefficients with open area ratios β of 1%, 3%, and 5% and hole diameters b of the through-holes 2*a* of 0.5 mm, 1.0 mm, and 3.0 mm are determined in board thickness t of the internal plate 2 of 0.3 mm, 0.5 mm and 1.0 mm. Consequently, in the board thickness t of 0.3 mm, as shown in FIG. 4, the absorption coefficient of 0.3 or more was confirmed when the hole diameter b was 0.5 mm or less and the open area ratio β was 3% or less. In the board thickness t of 0.5 mm, as shown in FIG. 5, the absorption coefficient of 0.3 or more was confirmed when the hole diameter b was 1 mm or less, and the open area ratio β was 3% or less. In the plate thickness t of 1.0 mm, as shown in FIG. 6, the absorption coefficient of 0.3 or more are confirmed when the hole diameter b was 0.8 or less, and the open area ratio β, was 5% or less.

The design conditions for parameters to attain an absorption coefficient of 0.3 or more are determined based on these results. In a layer thickness d of 10-50 mm, it was consequently derived that the open area ratio β is 3% or less, the board thickness t is 0.3 mm or more, and the hole diameter b is 1 mm or less.

When the sound source to be insulated is 70 dB or more, the hole diameter b may be set to 3 mm or less in the design conditions for parameters. The deriving method of such design conditions is described in reference to FIGS. 7 and 8.

Figure 7:
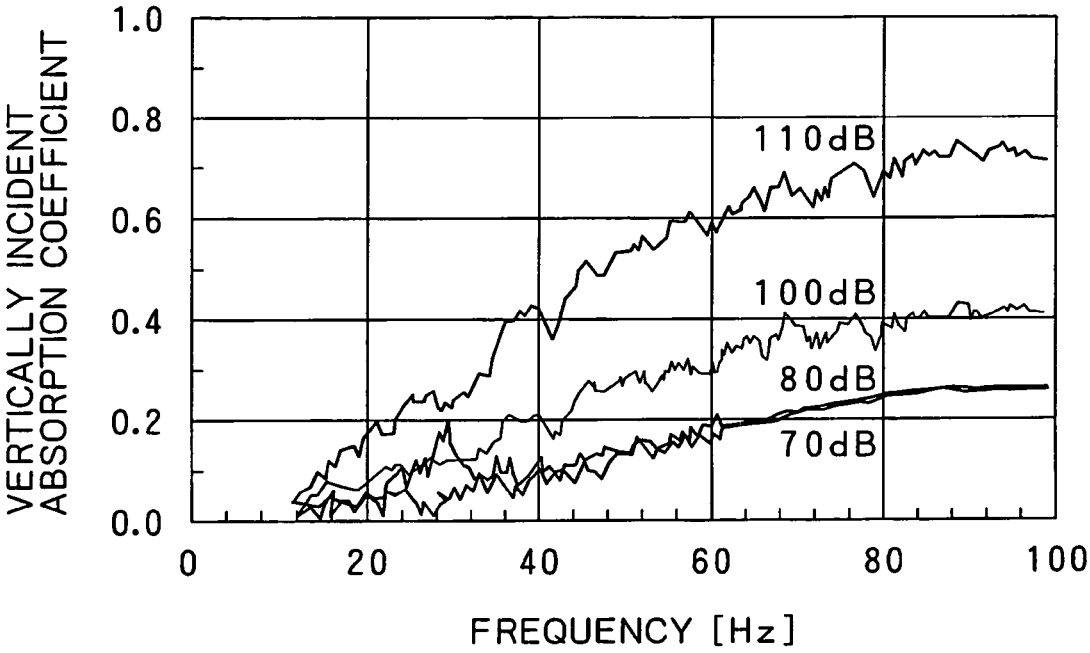
FIG. 7 is a graph showing the relation between absorption coefficient and sound pressure level in a hole diameter of 3 mm.

In the perforated soundproof structure shown in FIG. 1, the absorption coefficient in the incidence of a sound pressure of 70-110 dB was determined with an open area ratio β of 2%, a hole diameter d of 2 mm, and a layer thickness d of the air layer 3 of 950 mm in a board thickness t of 0.8 mm. Consequently, it was confirmed, as shown in FIG. 7, that the higher the sound pressure level is, the more satisfactory the absorption coefficient is.

The absorption coefficient and sound pressure level with open area ratios β of 1%, 3% and 5%, a hole diameter b of 3 mm, and a layer thickness of 30 mm in a board thickness t of 0.8 mm were similarly determined. Consequently, it is found from FIG. 8 that the higher the sound pressure level is, the larger the absorption coefficient is. When the open area ratio is 3%, the absorption coefficient of 0.3 or more is attained in the higher sound pressure range from about the sound pressure level of 70 dB. When the open area ratio is 1%, the absorption coefficient of 0.3 or more is shown from the lower pressure level.

The setting condition of the parameters to attain an absorption coefficient of 0.3 or more is determined based on these results. It was consequently delivered that the open area ratio β is 3% or less, and the hole diameter b is 3 mm or less in 70 dB or more. When the hole diameter b of the through-holes is 3 mm or less, it is effective for noises having high sound pressure levels because of the damping effect by pressure loss, and suitably used for the sound absorption of a place having a high sound pressure level.

Figure 9:
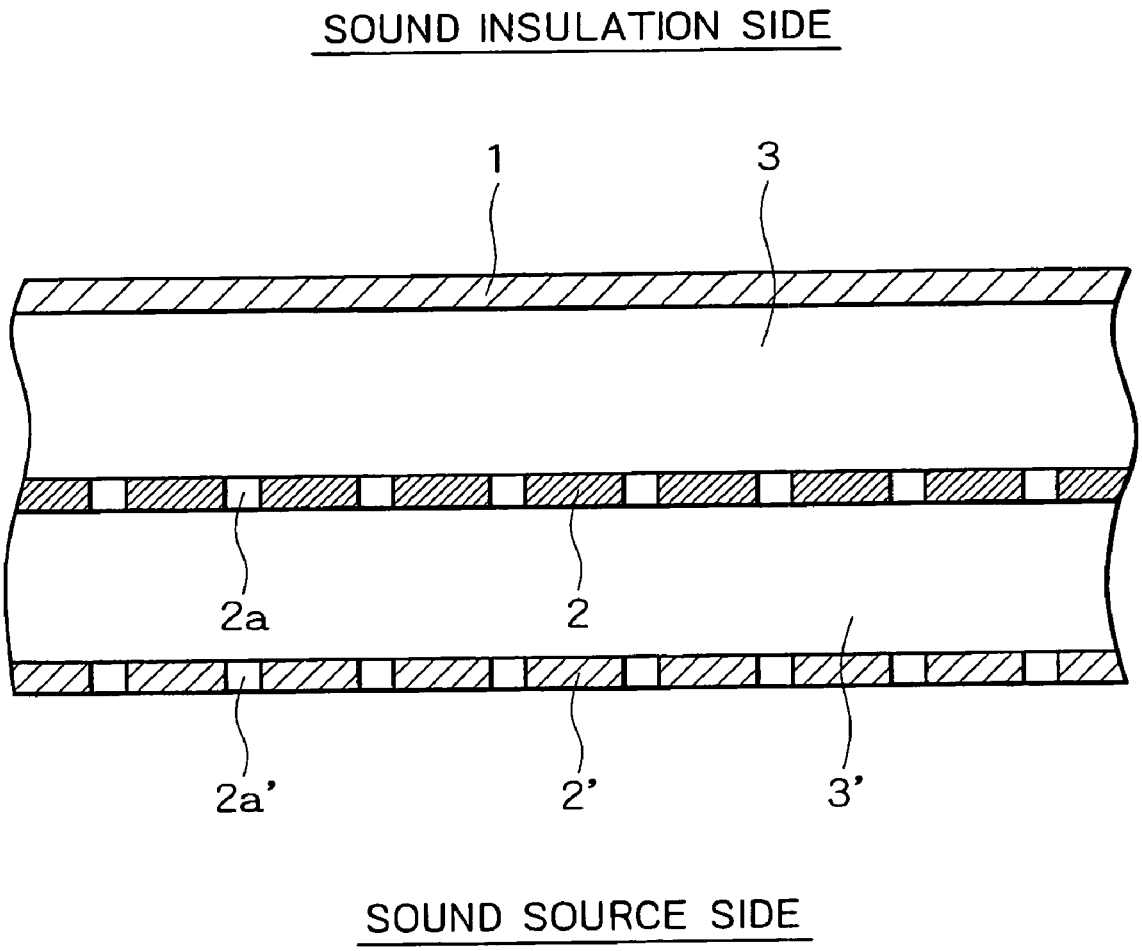
FIG. 9 is a sectional view showing a modified example of the perforated soundproof structure according to the first embodiment of the present invention.
Figure 10:
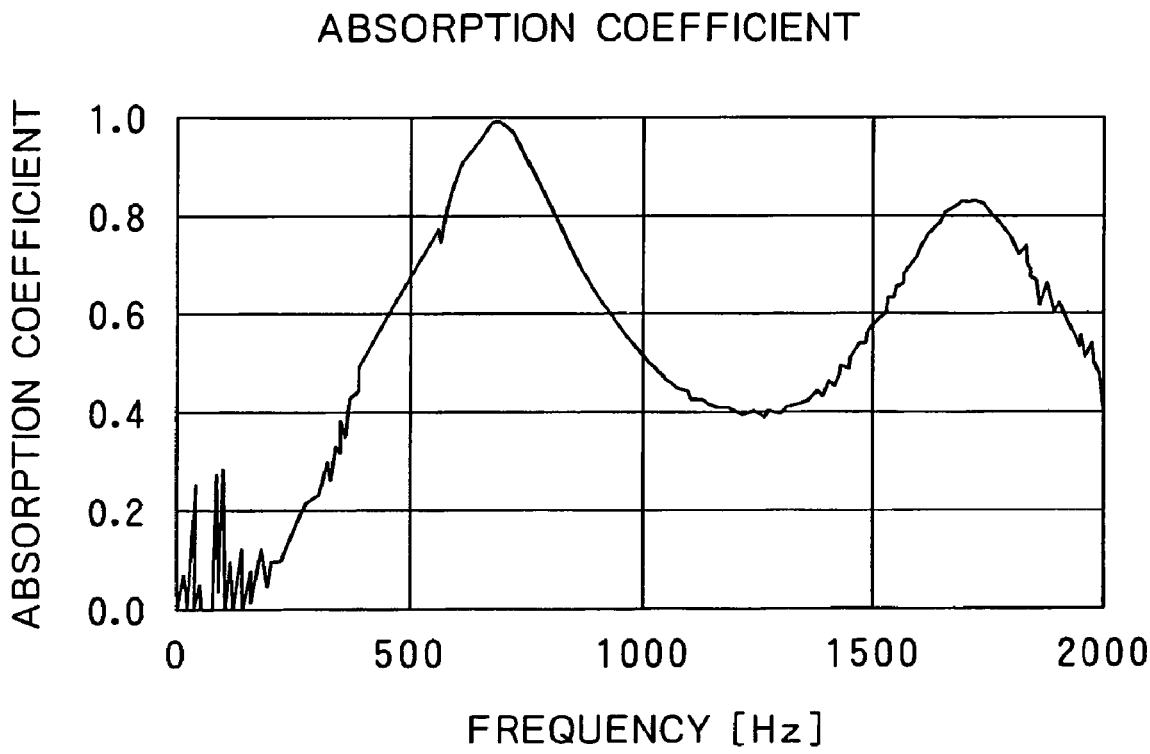
FIG. 10 is a graph showing the sound absorbing characteristics thereof.

A modified example of the first embodiment is described in reference to FIGS. 9 and 10.

The perforated soundproof structure shown in FIG. 9 further comprises an internal plate 2' having a number of through-holes 2*a'* on the internal plate 2 side of the perforated soundproof structure shown in FIG. 1 through an air layer 3'. The position of the through-holes 2*a* of the internal plate 2 may be the same as the through-holes 2*a'* of the perforated plate 2' or shifted therefrom.

Concretely, when the parameters are set to a back air layer thickness t of the air layer 3' of 20 mm, an open area ratio β of the internal plate 2' of 1%, a board thickness t of 0.6 mm, and a hole diameter b of 0.5 mm, as shown in FIG. 10, a resonance frequency of about 1700 Hz is obtained in addition to a resonance frequency of about 700 Hz. Accordingly, this structure has a high absorption coefficient in a wide range up to high frequency bandwidth, compared with the one having only one internal plate.

In the perforated soundproof structure shown in FIG. 9, the number of internal plates is further increased, whereby resonance frequencies can be increased in response to the setting number. Accordingly, the structure can be constituted to have a high absorption coefficient in a wide range up to further high frequencies.

As described above, the parameters of the perforated soundproof structure (layer thickness d, open area ratio β, board thickness t, and hole diameter d) are adjusted in this embodiment, whereby the viscous effect is generated in the air passing through the through-holes 2*a*. Among the parameters, the open area ratio β is desirably set to 3% or less. Further, the perforated soundproof structure may be constituted, paying attention only to the open area ratio β. Namely, the perforated soundproof structure may be formed by oppositely arranging the external plate 1 and the internal plate 2 having an open area ratio β of 3% or less. When the open area ratio β is set to 3% or less, the viscous effect can be generated in the air passing through the through-holes 2*a* as shown in FIGS. 4-6.

Among the parameters, the hole diameter b is desirably set to 1 mm or less. The perforated soundproof structure may be constituted, paying attention only to the hole diameter d of the through-holes 2*a*. Namely, the perforated soundproof structure may be formed by oppositely arranging the external plate 1 and the internal plate 2 having a number of through-holes 2*a* having hole diameters b of 1 mm or less. When the hole diameter b of the through-holes 2*a* is set to 1 mm or less, the viscous effect can be surely generated in the air passing through the through-holes 2*a* since the absorption coefficient is sharply raised with the hole diameter of 1 mm as a boundary.

Figure 8:
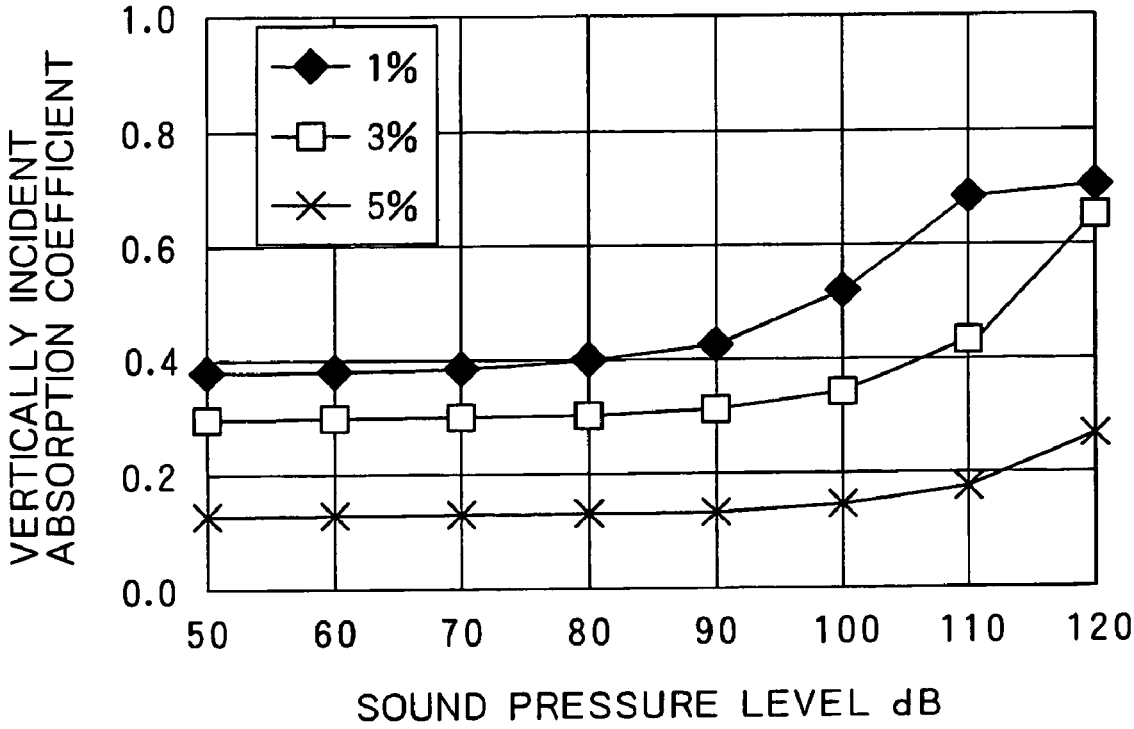
FIG. 8 is a graph showing the relation among sound pressure level, absorption coefficient and open area ratio in a hole diameter of 3 mm.

When the sound source to be isolated is 70 dB or more, the hole diameter b of the parameters is desirably 3 mm or less. Further, in this case, the perforated soundproof structure may be constituted, paying attention only to the hole diameter b of the through-holes 2*a*. Namely, the perforated soundproof structure may be formed by oppositely arranging the external plate 1 and the internal plate 2 having a number of through-holes 2*a* having hole diameters of 3 mm or less. When the hole diameter b of the trough-holes 2*a* is set to 3 mm or less, the damping effect by pressure loss can be generated in the air passing through the through-holes 2*a*, as shown in FIG. 8, when the sound source to be insulated is 70 dB or more.

The limit value of hole diameter b of the through-holes 2*a* is preferably 0.2 mm. The reason for this is that when the hole diameter b reaches 0, the peak of the absorption coefficient is 1.0 or more in theory, but not in practice, and when the hole diameter is extremely small as 0.2 or less, the resistance to the air flow in the through-holes 2*a* part is increased because of excessively large viscosity of the air in the through-holes 2*a*, oppositely resulting in a reduction in absorption coefficient. Further, the extremely small hole diameter b as 0.2 mm or less makes the manufacture greatly difficult, and the through-holes 2*a* are apt to be blocked by dirt or dust depending on the using environment.

In this embodiment, the through-holes 2*a* of the internal plate 2 are formed circularly. However, the present invention is never limited thereby, and elliptic, rectangular, polygonal or slit-like shapes can be adapted. The through-holes 2*a* don't need to be set to the same size and diameter, and may include various sizes or diameters. When various sizes or diameters are included, the frequency bandwidth for exhibiting sufficient sound absorbing performance can be extended.

A second embodiment of the perforated soundproof structure according to the present invention is then described in reference to FIGS. 11-20.

The perforated soundproof structure of this embodiment is suitably used as a noise-proof cover for moving devices provided with drive mechanism such as engine in the inner part or facility machines provided with drive mechanism such as motor or gear in the inner part, including, for example, an automobile, a rolling stock, a construction vehicle, a vessel, and an automatic carrying device.

Figure 11:
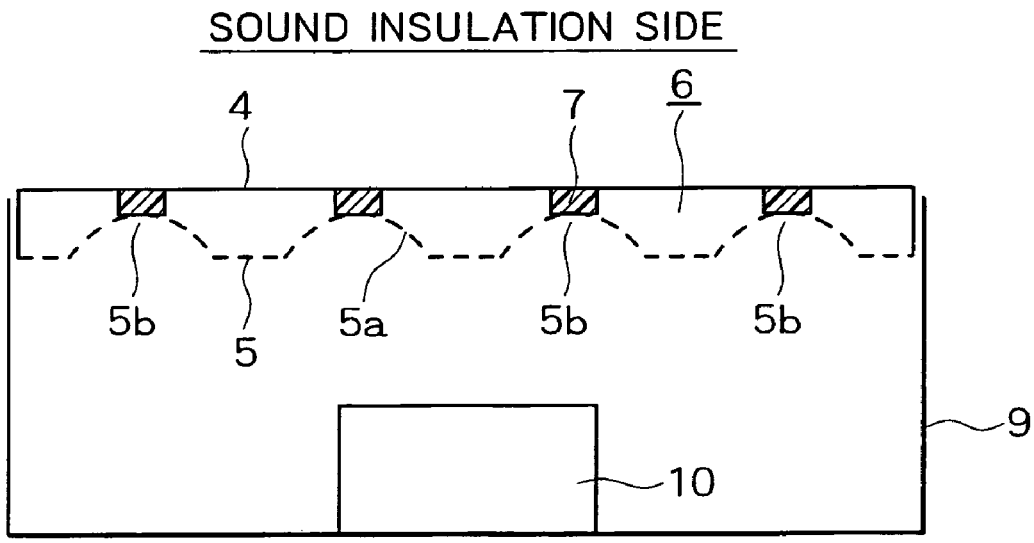
FIG. 11 is a sectional view showing a perforated soundproof structure according to a second embodiment of the present invention.

The perforated soundproof structure shown in FIG. 11 comprises a flat external plate 4 facing the outside where noise is at stake, and an internal plate 5 facing a noise-generating sound source 10 consisting of a drive mechanism such as engine. The perforated soundproof structure further comprises a partition wall member 9 for surrounding the circumference of the sound source 10 to cover it. The external plate 4 and internal plate 5 are formed of metals such as iron or aluminum or a synthetic resin. The external plate 4 and internal plate 5 are desirably formed of the same material to dispense with the separating work in recycle.

The external plate 4 and internal plate 5 are oppositely arranged through an air layer 6. The internal plate 5 has a number of circular through-holes 5*a*. The layer thickness d of the air layer 6 and the open area ratio β, board thickness t, and hole diameter b of the internal plate 5 are set to give rise to a viscous effect in the air passing through the through-holes 5*a* of the internal plate 5 as described in first embodiment, where the frequency bandwidth to attain an absorption coefficient of 0.3 or more is set to 10% or more of the resonance frequency. These parameters (layer thickness d, open area ratio β, board thickness t, and hole diameter b) may be set also by use of the above-mentioned general equation of the Helmholz resonance principle.

The internal plate 5 having a number of through-holes 5*a* has a plurality of protruding parts 5*a* for enhancing the rigidity of the internal plate 5 dispersively arranged thereon. The protruding parts 5*b* may be linearly provided from one end to the other end of the plate. Each protruding part 5*b* is formed so that the apex is located on the external plate 4 side, and the apex of the protruding part 5*b* is bonded to the external plate 4 through a damping member 7 for damping vibration.

The damping member 7 is formed of a viscous resin or damping elastic member. As the viscous resin, any resin can be used without being particularly limited to a specified resin if it has damping property to vibration. However, it is preferably made into a soft foamed urethane by thermally treating a polyester or polyether resin followed by foaming. Further, the viscous resin may be a polyester or polyether resin as it is or modified with silicon or the like, or consist of a single resin or a proper mixture of a plurality of resins. The damping member 7 may be formed of an elastic porous body. In this case, it has the damping function of damping vibration and the sound absorbing function of absorbing noise. The damping elastic member is formed of, for example, a rubber vibration isolator.

The operation of the perforated soundproof structure is then described.

When the sound source 10 generates noise, the noise advances to the perforated soundproof structure arranged oppositely to the sound source 10. When the noise reaches the perforated soundproof structure, noise components of the circumferential bands of the resonance frequency are absorbed in a high absorption coefficient. Accordingly, the noises of the essential frequency band generated by the sound source 10 such as engine can be isolated.

When the sound source 10 is vibrated, the vibration is transmitted to the perforated soundproof structure through the partition wall member 9 surrounding the sound source 10 to excite the external plate 4 and the internal plate 5 of the perforated soundproof structure. The external plate 4 and internal plate 5 thus receive the effect of deforming with undulation at a wavelength corresponding to the frequency of the vibration, but the deformation is sufficiently suppressed by the protruding parts 5*b* of the internal plate 5 and the damping member 7.

Namely, since the internal plate 5 has high rigidity enhanced by the protruding parts 5*b*, it is hardly deformed only by receiving a mechanical exciting force by vibration from the sound source 10.

On the other hand, since the external plate 4 bonded to the internal plate 5 through the damping member 7 is low in rigidity because it is formed in a flat form, it is in a state easy to deform (vibrate) by a mechanical exciting force. Accordingly, when the mechanical exciting force is given to the external plate 4, the external plate 4 is deformed with undulation by the exciting force. However, the distortion energy accompanied by this deformation is absorbed by the damping member 7 supported on the internal plate 5. Consequently, even if the flat external plate 4 is in the easily deformable state because of the low rigidity, its deformation by mechanical excitation is sufficiently suppressed.

The perforated soundproof structure can absorb noises of an essential frequency band by absorbing the noise of the sound source 10 by use of the sound absorbing effect of the perforated material as the internal plate, and further sufficiently suppress the generation of noise by the vibration of the soundproof structure itself, since it is hardly vibrated even if the mechanical excitation by the sound source 10 is given thereto. Namely, this structure has sound isolating characteristic. Consequently, this structure is suitable as a noise-proof cover for automobile or rolling stock in which the noise generated form the sound source 10 and the noise resulted from the vibration by mechanical excitation is to be isolated.

Modified examples of the second embodiment are described in reference to FIGS. 12-17. In FIGS. 12-17, the same symbols as in FIG. 5 show the same members, and the descriptions therefor are omitted.

Figure 12:
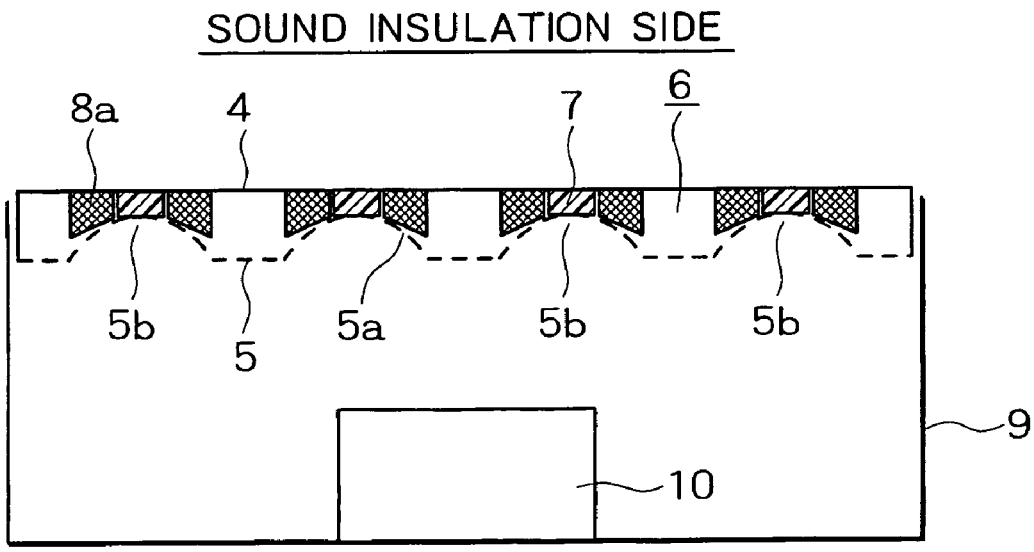
FIG. 12 is a sectional view showing a modified example of the perforated soundproof structure according to the second embodiment of the present invention.

The perforated soundproof structure may comprise, as shown in FIG. 12, an annular first sound absorption member 8*a* consisting of a porous body provided around the damping member 7 of the perforated soundproof structure shown in FIG. 11. Since noises of a band wider than the frequency band absorbable by the sound absorbing effect of the perforated plate as the internal plate can be absorbed by the first sound absorbing member 8*a*, the sound insulating performance can be further improved.

Figure 13:
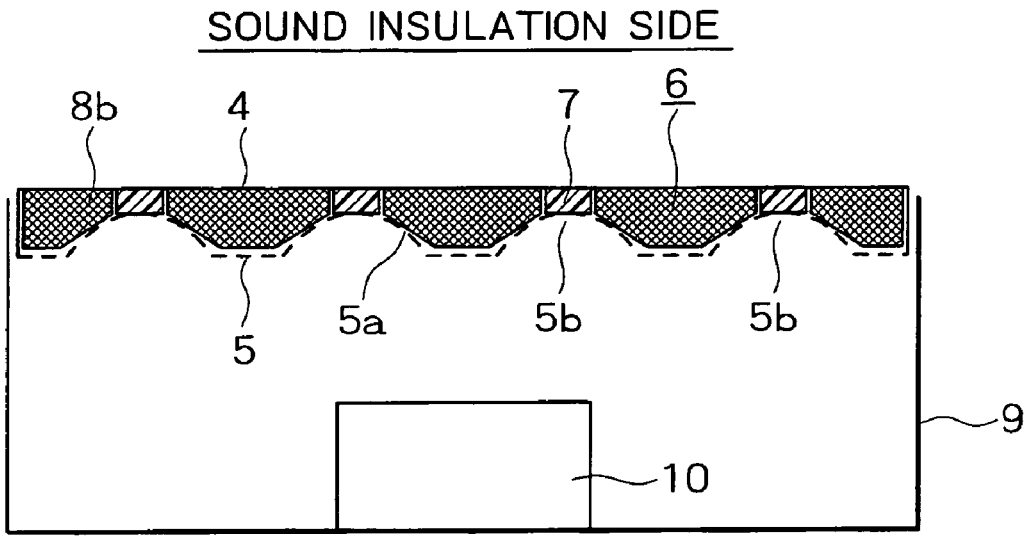
FIG. 13 is a sectional view showing another modified example of the perforated soundproof structure according to the second embodiment of the present invention.

The perforated soundproof structure may comprise, as shown in FIG. 13, a second sound absorbing member 8*b* consisting of a porous body, which is provided entirely in the space enclosed by the external plate 4, internal plate 5 and damping member 7 of the perforated soundproof structure shown in FIG. 11 to form the air layer 6 by the second sound absorbing member 8*b*. The noise of a wide frequency band can be further sufficiently absorbed by the second sound absorbing member 8*b* having a large volume.

Figure 14:
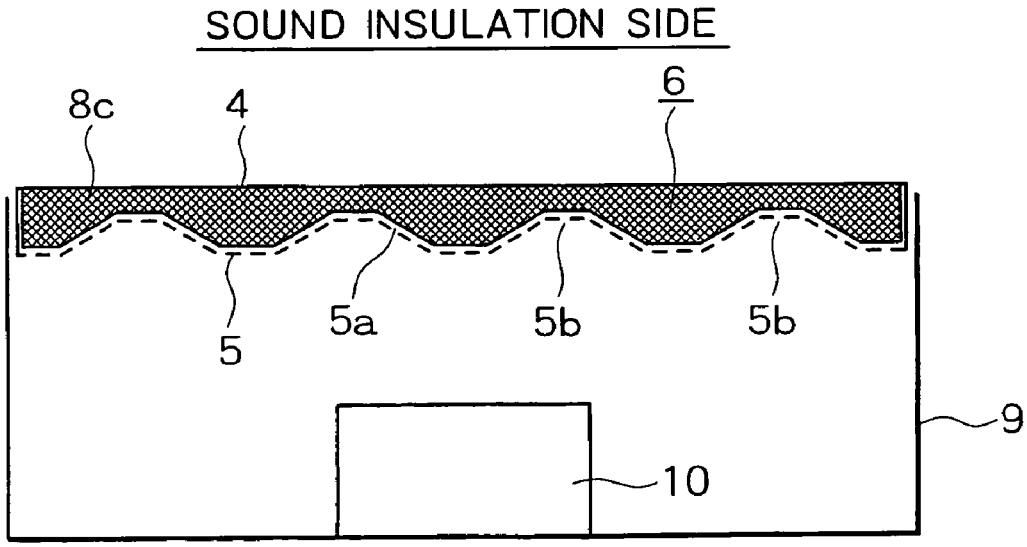
FIG. 14 is a sectional view showing the other modified example of the perforated soundproof structure according to the second embodiment of the present invention.

The perforated soundproof structure may comprise, as shown in FIG. 14, a third sound absorbing member 8*c* consisting of a porous body, which is provided entirely in the space enclosed by the external plate 4 and internal plate 5 of the perforated soundproof structure shown in FIG. 11 to form the air layer 6 by the third member 8*c*, the protruding parts 5*b* of the internal plate 5 being bonded to the external plate 1. Since the function of the damping member 7 can be exhibited by the third sound absorbing member 8*c*, the number of part items can be reduced.

Figure 15:
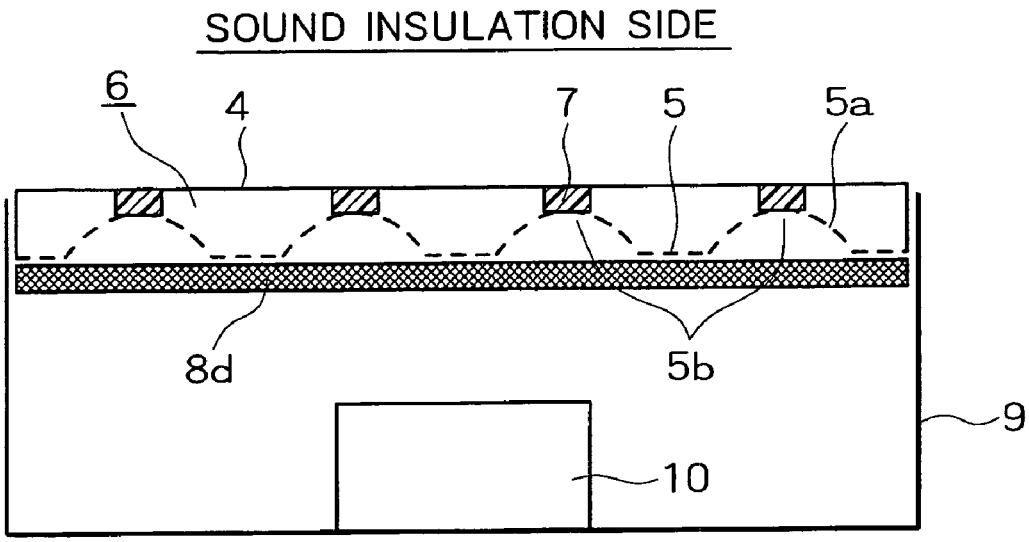
FIG. 15 is a sectional view showing further another modified example of the perforated soundproof structure according to the second embodiment of the present invention.
Figure 16:
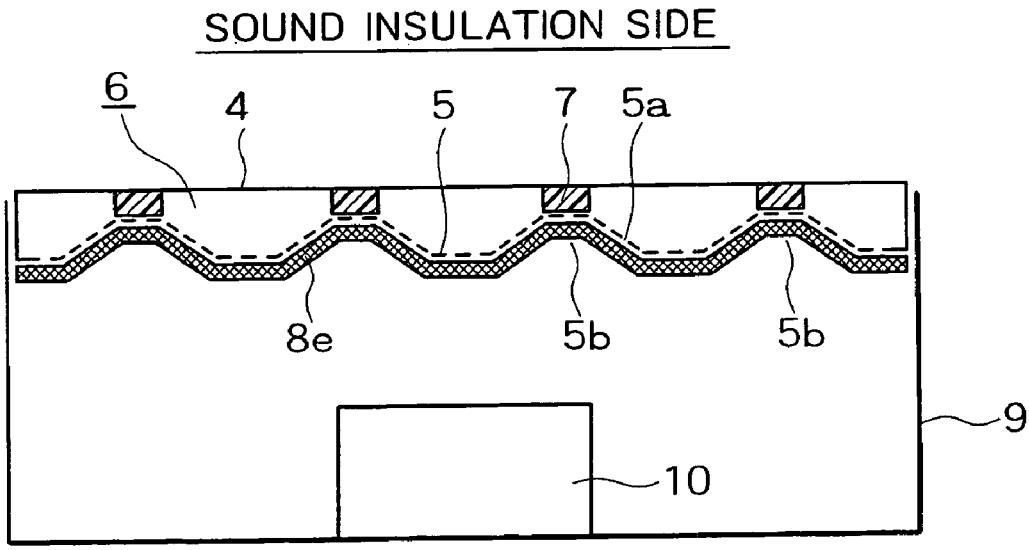
FIG. 16 is a sectional view showing the other modified example of the perforated soundproof structure according to the second embodiment of the present invention.

The perforated soundproof structure may comprise, as shown in FIG. 15, a flat fourth sound absorbing member 8*d* consisting of a porous body, which is provided entirely over the bottom surface of the sound source 10 side of the internal plate 5 of the perforated soundproof structure shown in FIG. 11. Further, it may comprise, as shown in FIG. 16, a fifth sound absorbing member 8*e* consisting of a porous body, which is stuck along the whole bottom surface of the internal plate 5. Since the absorbing members absorb noises of a wide frequency band, the sound insulating performance is further improved. The internal plate 5 and the perforated plate 15 can accomplish the same effect by using the through-holes and perforated plate of the same specification as in the first embodiment.

In the modified examples shown in FIGS. 12-16, the porous bodies constituting the first to fifth sound absorbing members may be formed by compressing a metal fiber or rectangular metal such as aluminum or stainless. The porous bodies further may be formed of nonwoven fabrics or foamed bodies of metals or resin materials. When the external plate 4 and internal plate 5 are made of metals, the damping member 7 is desirably formed of the same metal so that satisfactory recycling property can be obtained.

Figure 17:
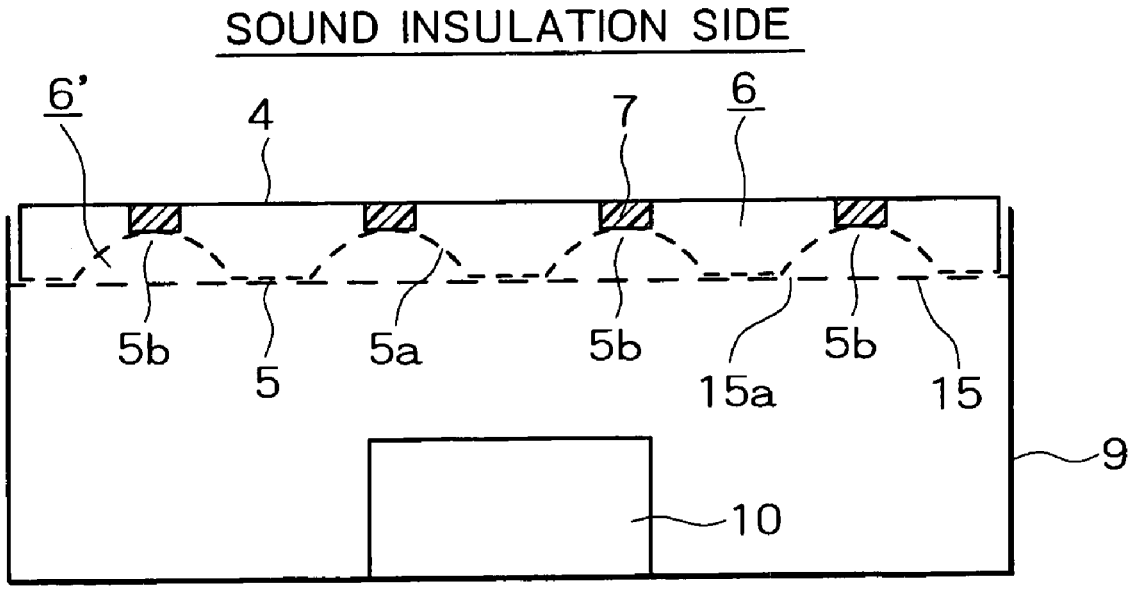
FIG. 17 is a sectional view showing another modified example of the perforated soundproof structure according to the second embodiment of the present invention.

The perforated soundproof structure may comprise, as shown in FIG. 17, a perforated plate 15 having a number of circular through-holes 15*a* as a sound absorbing member, which is provided entirely over the sound source 10 side of the internal plate 5 of the perforated soundproof structure shown in FIG. 11. The flat perforated plate 15 can be stuck in contact with the sound source 10-side apexes of the internal plate 5, or mounted on both sides of the internal plate 5 to be separated from the apexes. When the perforated plate 15 is provided in this way, an air layer 6' is formed between the internal plate 5 and the perforated plate 15. Accordingly, in addition to the resonance frequency by the internal plate 5, the resonance frequency corresponding to the perforated plate 15 can be made appear to satisfactorily absorb the noises of the peripheral frequency bands of these resonance frequencies. Accordingly, noises of a wide frequency band can be absorbed, and the sound insulating performance can be further improved. The position of the through-holes 5*a* of the perforated plate 5 may be the same as the through-holes 15*a* of the perforated plate 15, or shifted therefrom. Further, when one or more perforated plates are further set in parallel to the perforated plate 15 through air layers, the resonance frequencies are further increased according to the setting number. Accordingly, a structure having a high absorption coefficient in wide circumferential ranges of many frequencies can be provided.

The internal plate 5 and the perforated plate 15 can accomplish the same effect by using the through-holes and perforated plate of the same specification as in the first embodiment.

The perforated soundproof structures of this embodiment are more specifically described in reference to examples.

EXAMPLE

As described above, the perforated soundproof structures constituted as shown in FIGS. 11-16 were examined for absorption coefficient and radiated sound pressure level. In the examination, the structures of FIGS. 11, 12, 13, 14, 15 and .16 were taken as Examples 1, 2, 3, 4, 5 and 6, respectively. As the examination results of Examples 1-6 are shown in FIG. 18 for the absorption coefficient and in FIG. 19 for the radiated sound pressure level, respectively.

Comparative Example

Figure 21:
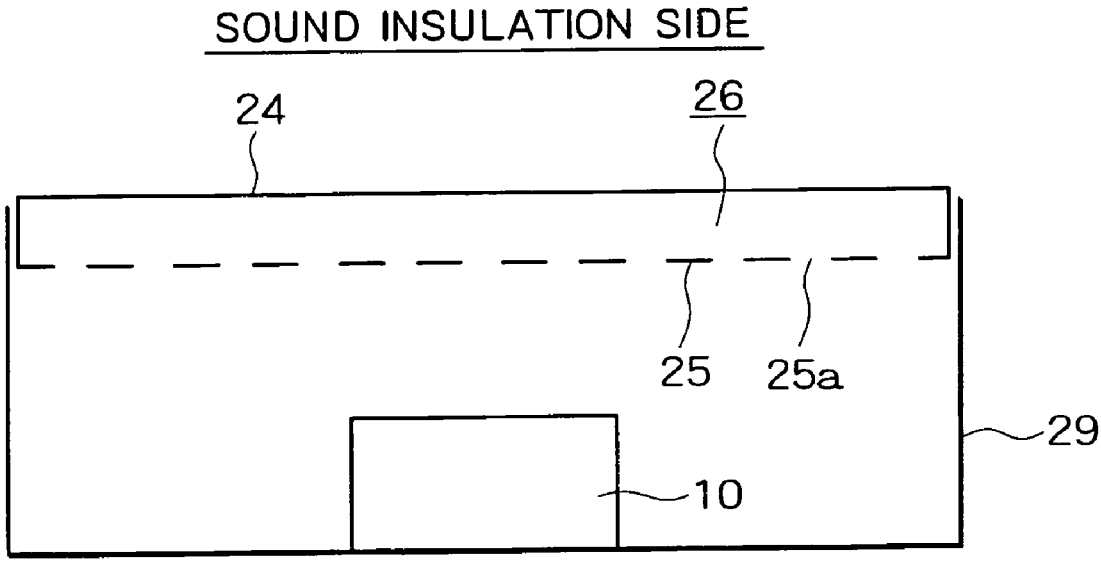
FIG. 21 is a sectional view of an embodiment of a conventional perforated soundproof structure.

A perforated soundproof structure constituted as shown in FIG. 21 was examined as Comparative Example for absorption coefficient and emitted sound pressure level. The examination result of Comparative Example is shown in FIG. 18 for the absorption coefficient and in FIG. 19 for the radiated sound pressure level.

Figure 18:
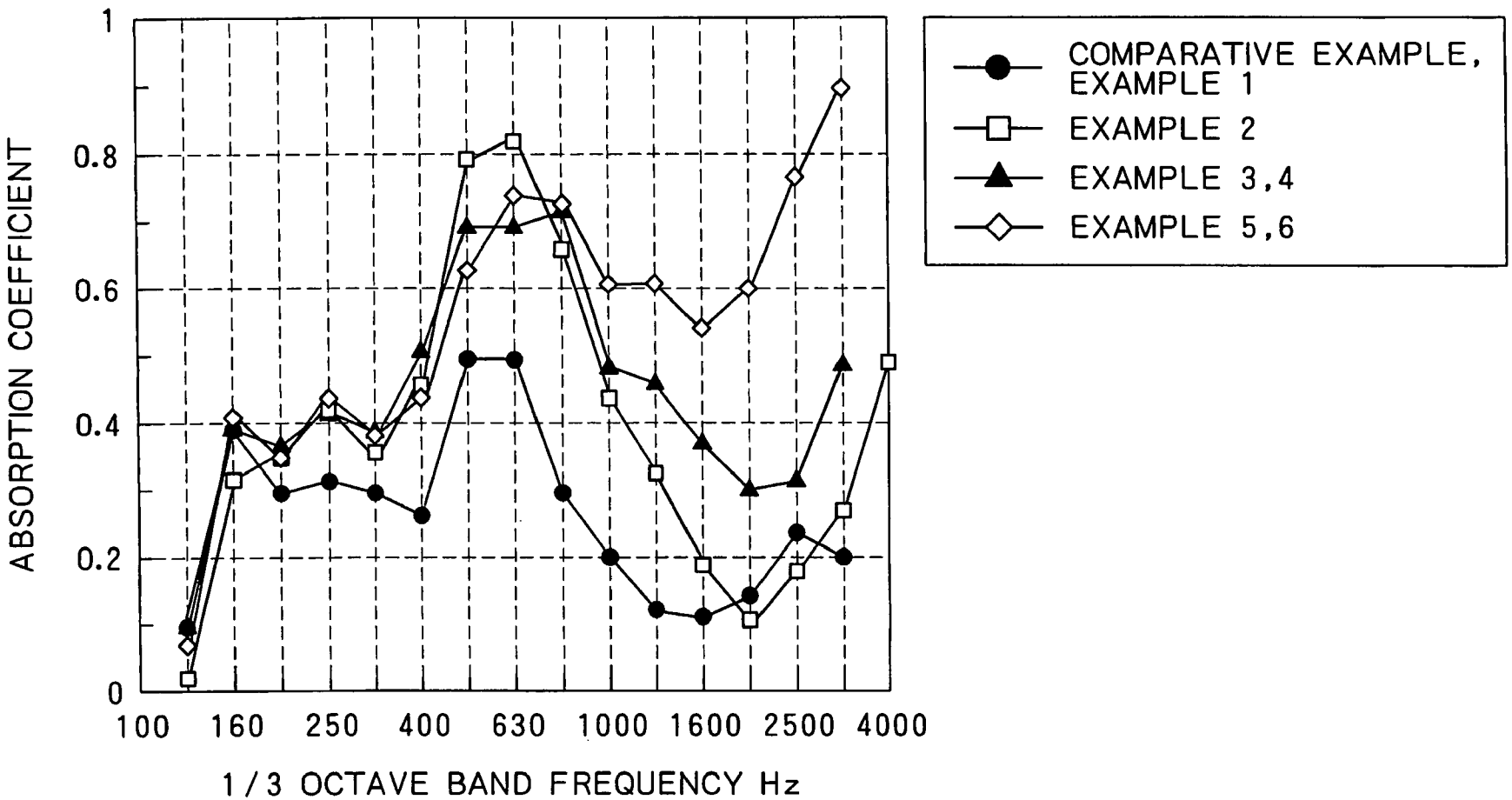
FIG. 18 is a graph showing sound absorbing characteristics.
Figure 19:
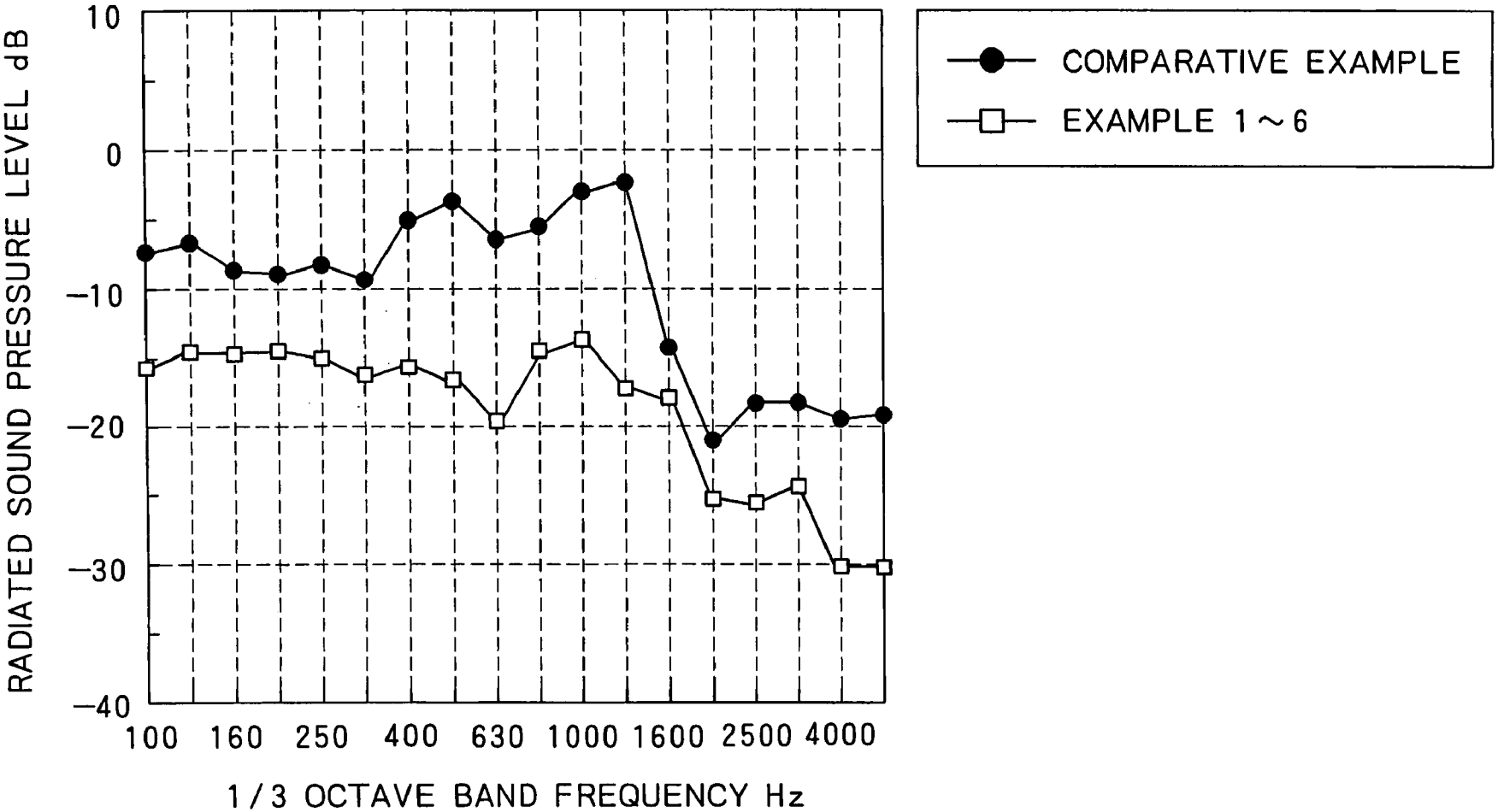
FIG. 19 is a graph showing sound pressure characteristics.
Figure 20:
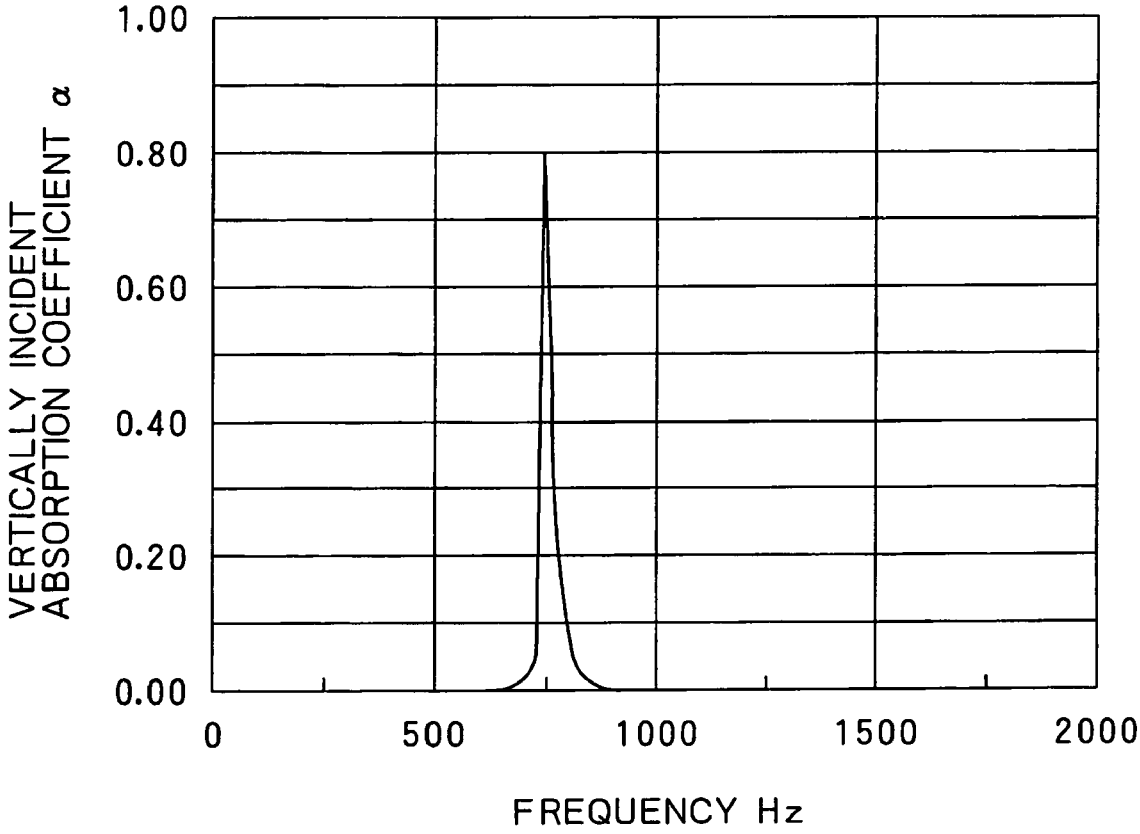
FIG. 20 is a graph showing sound absorbing characteristics.

In the relation between Example 1 and Comparative Example, as shown in FIG. 18, the both show the same sound absorbing characteristics that the absorption coefficient is increased in a frequency band of 500-630 Hz, but it was confirmed, as shown FIG. 19, that the radiated sound pressure level of Example 1 provided with the damping member 7 is more excellent than Comparative Example. Accordingly, it was confirmed that the noise generated by the vibration of the external plate 4 itself by mechanical excitation could be reduced by the damping member 7.

In the relations between Examples 2-6 and Comparative Example, as shown in FIG. 18, it was confirmed that Examples 2-6 provided with the first to fifth sound absorbing members show high absorption coefficients in a wider frequency band than in Comparative Example. Accordingly, it was confirmed that the first to fifth sound absorbing members absorb sounds in a wide frequency band, particularly, the sound absorbing members 8*d* and 8*e* provided entirely over the sound source 10-side bottom surface of the internal plate 5 as in Example 5 and 6 show high absorption coefficients even in a high frequency band.

The perforated soundproof structure according to the present and the method of manufacturing the same can surely exhibit sufficient sound absorbing performance.

AVAILABILITY IN INDUSTRY

The perforated soundproof structure according to the present invention and the method of manufacturing the same are useful for a cover for reducing the sound from a noise-generating source. In general, it is also suitably used for a noise-proof cover to be set in a mechanically excited place.

The invention claimed is:

1. A perforated soundproof structure comprising an external plate, an internal plate having a number of through-holes, and a plurality of damping members configured to damp vibration, the internal plate being arranged opposite to the external plate, the internal plate having a plurality of protruding parts formed so as to locate apexes of the plurality of protruding parts at the external plate side; and each of the plurality of damping members being placed between one of the apexes of the plurality of protruding parts and the external plate, and being coupled with the one of the apexes of the plurality of protruding parts and the external plate, wherein a space between each two adjacent damping members is not filled with the same material as material forming the plurality of damping members.

2. The perforated soundproof structure according to claim 1, wherein the plurality of damping members are formed of sound absorbing members having the function of absorbing noise.

3. The perforated soundproof structure according to claim 2, wherein each of the sound absorbing members is a porous body obtained by compressing a fibrous or rectangular metal or a porous body made of a nonwoven fabric.

4. The perforated soundproof structure according to claim 1, further comprising a sound absorbing member for absorbing noise provided around the each of the plurality of damping members.

5. The perforated soundproof structure according to claim 4, wherein the sound absorbing member is a porous body obtained by compressing a fibrous or rectangular metal or a porous body made of nonwoven fabric.

6. The perforated soundproof structure according to claim 1, comprising a sound absorbing member provided entirely over the sound source side of the internal plate.

7. The perforated soundproof structure according to claim 6, wherein the sound absorbing member is a porous body obtained by compressing a fibrous or rectangular metal or a porous body made of a nonwoven fabric.

8. The perforated soundproof structure according to claim 6, wherein the sound absorbing member comprises one or more perforated plates having a number of through-holes, an air layer being formed between adjacent perforated plates.

9. A perforated soundproof structure comprising an external plate, one or more internal plates having a number of through-holes, and a plurality of damping members configured to damp vibration the one or more internal plates being arranged opposite to the external plate, a board thickness, a hole diameter and an open area ratio of the internal plate being set to satisfy design conditions to give rise to a viscous effect in the air passing through the through-holes;

the design conditions being set so that the frequency bandwidth to attain an absorption coefficient of 0.3 or more being 10% or more of the resonance frequency; the internal plate having a plurality of protruding parts formed so as to locate apexes of the plurality of protruding parts at the external plate side; and each of the plurality of damping members being placed between the apex of the one protruding part or at least one of the apexes of the plurality of protruding parts and the external plate, and being coupled with the one of the apexes of the plurality of protruding parts and the external plate, wherein a space between each two adjacent damping members is not filled with the same material as material forming the plurality of damping members.

* * * * *